US005175522A

United States Patent [19]

Clark et al.

[11] Patent Number: 5,175,522

[45] Date of Patent: Dec. 29, 1992

[54] GROUND PLANE CHOKE FOR STRIP TRANSMISSION LINE

[75] Inventors: Robert T. Clark, Buena Park; Dean C. Quick, Tustin, both of Calif.

[73] Assignee: Hughes Aircraft Company, Los Angeles, Calif.

[21] Appl. No.: 697,819

[22] Filed: May 9, 1991

[51] Int. Cl.[5] ..... H01P 1/00

[52] U.S. Cl. ..... 333/246; 333/260

[58] Field of Search ..... 333/238, 246, 260

[56] References Cited

U.S. PATENT DOCUMENTS

| | | | |
|---|---|---|---|
| 3,908,185 | 9/1975 | Martin | 333/238 X |
| 4,208,642 | 6/1980 | Saunders | 333/246 |
| 4,782,313 | 11/1988 | Brant, Jr. | 333/246 |

*Primary Examiner*—Paul Gensler

*Attorney, Agent, or Firm*—Wanda K. Denson-Low

[57] ABSTRACT

The ends of two strip transmission line substrates which meet at an interface are supported by resting on top of a sandwich structure made up of a dielectric, a circular metal choke member and a conductive pedestal. The choke member, the dielectric and the ground planes of the substrates form a low-loss RF ground connection to bridge the gap at the interface. The choke member, the dielectric and the ground planes form a quarter wave open circuited transmission line stub in the form of a circular structure. This structure acts as an RF choke and reflects a short circuit into the region between the ground planes, making a virtual connection between the ground planes and the metal choke member. The strip transmission line substrates and the metallic choke member are not rigidly connected, thus allowing for relative movement between the substrate and choke member due to differences in thermal expansion or contraction. A semicircular choke is employed at an interface between a strip transmission line substrate and a coaxial connector, or at an interface between a strip transmission line substrate and a microwave circuit element such as a high-power solid state microwave power amplifier transistor.

6 Claims, 2 Drawing Sheets

Fig. 5.
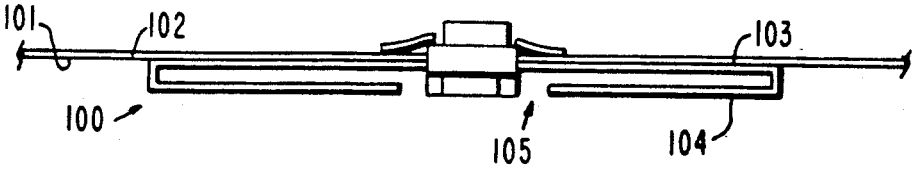
Fig. 4.
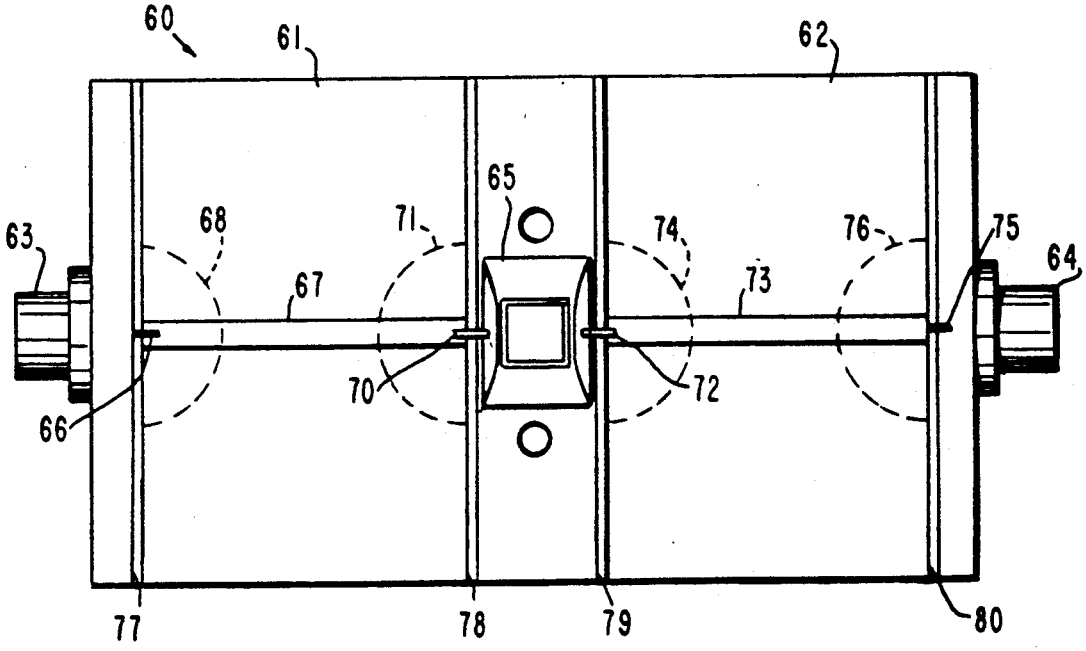
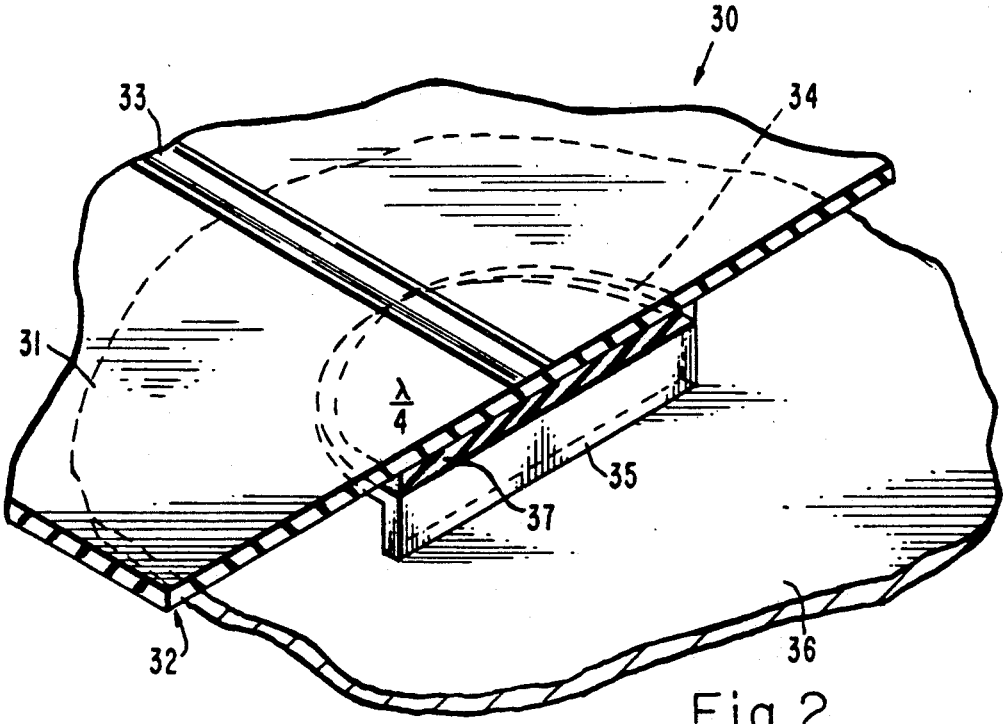
Fig. 2.

GROUND PLANE CHOKE FOR STRIP TRANSMISSION LINE

BACKGROUND

The present invention relates to an RF ground plane choke for strip transmission line media and, more particularly, to a choke which provides for a noncontacting RF ground plane to ground plane connection at an interface without introducing discontinuities that adversely affect VSWR (voltage standing wave ratio) and which allow relative movement between the strip transmission line substrate and supporting metal carrier due to differences in thermal expansion or contraction. The term "strip transmission line" as used herein refers to a transmission line medium such as strip line, or microstrip line, or similar media, in contrast to coaxial media.

Heretofore, RF ground plane to RF ground plane connection between strip transmission line alumina substrates at an interface has been made by attaching the ground plane to a metal carrier, chassis or container by using solder or a conductive epoxy cement. However, a solder connection fails when subjected to a low shear stress generated by differences in thermal expansion or contraction between the substrate and metallic ground. If smaller substrates are used to reduce the differences in the thermal expansion or contraction, then more sections, and thus more interconnects, are needed to cover the same area. However, increasing the number of interconnects degrades the electrical performance while at the same time lowering the yield and reliability of the assembly. Bonding by use of conductive epoxy cement does not provide an adequate low-loss RF ground connection. Furthermore, attachment by means of solder or conductive epoxy involves many critical production steps that are not easily carried out.

As an alternative, a soft board material (Teflon ceramic composite) has been used in place of the alumina substrate, the soft board material having been prelaminated to a thick aluminum metal plate for grounding purposes. However, it is difficult to establish a reliable, low-loss short circuit connection from the strip transmission line circuit side to the ground plane using the softboard laminate because of dissimilar metals of the aluminum ground plane and circuit lines consisting of either copper or gold. The soft-board laminate can be obtained with a copper metal plate for grounding, but it is expensive and very heavy. Additionally, it is difficult to make a good wire bond to the circuit side of soft board laminate because it yields easily when subjected to the compressive forces of thermal compression or thermosonic wire bonding. Also, the soft-board composite can be obtained with a thin copper ground plane rather than a thick metal plate for grounding, but the softboard warps after the circuit has been etched on one side. These disadvantages plus the high cost, heavy weight and high hygroscopicity of laminated soft board make it a poor choice in comparison to an alumina substrate.

Employment of a virtual short circuit instead of metal-to-metal contact to provide an RF ground plane to RF ground plane connection in a microwave integrated circuit is disclosed in U.S. Pat. No. 4,611,186 to Ziegner entitled "Noncontacting MIC Ground Plane Coupling Using A Broadband Virtual Short Circuit Gap". However, the patent employs a two-part half wavelength waveguide transformer formed by shaped cavities in a metal housing that is not adaptable for use in allowing relative movement between the strip transmission line substrate and metal carrier due to differences in thermal expansion or contraction.

Accordingly, it is a feature of the present invention to provide a low-loss RF ground plane to RF ground plane connection in a strip transmission line medium without using metal-to-metal contact.

Another feature of the invention is the provision of an RF ground plane to RF ground plane connection in a strip transmission line medium that allows for relative movement due to differences in thermal expansion or contraction between the strip transmission line substrate and the metal carrier.

A further feature of the present invention is to provide a low-loss RF ground plane to ground plane connection in a strip transmission line medium that is not rigidly bonded using solder, or the like.

SUMMARY OF THE INVENTION

In accordance with these and other features of the invention, there is provided a strip transmission line ground plane RF choke comprising a quarter wavelength open-circuited transmission line stub in series between the strip transmission line substrate ground plane and a metallic choke member. The strip transmission line substrate ground plane forms one conductor and the metallic choke member forms the other conductor of the quarter-wavelength open-circuited transmission line stub. The strip transmission line substrate and the metallic choke member are not rigidly connected, thus allowing for relative movement between the substrate and the choke member due to differences in thermal expansion or contraction to be provided at strip transmission line interfaces. The quarter wavelength open-circuited transmission line stub creates a virtual short circuit at the interface to permit propagation of microwaves past the interface without introducing discontinuities that adversely affect VSWR and insertion loss. The strip transmission line substrate is supported at the interfaces by the metallic choke member covered by a ceramic-loaded dielectric spacer, the metallic choke member being affixed to the metal carrier, chassis or container.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 2 is an isometric view illustrating the construction of another embodiment of the RF choke of the present invention;

FIG. 4 is a top view of a chassis of a microwave system illustrating the RF choke of the present invention employed at four interfaces, two at strip transmission line substrate to coaxial connector interfaces, and two at strip transmission line substrate to microwave circuit element interfaces; and FIG. 5 is a side view in cross section of an embodiment of a half wave folded RF choke coupled to the input and output of a semiconductor device.

DETAILED DESCRIPTION

The present invention relates to RF coupling between a strip transmission line and another circuit element at an interface. The other circuit element may be a second strip transmission line, a semiconductor device, a coaxial cable connector, or the like. The strip transmission line may be of the type known as stripline or as micro-stripline, or the like. The term strip transmission line is intended to apply to any transmission line medium having a layered construction comprising a ground plane, a substrate and a circuit conductor, regardless of whether it is constructed by printing, plating, depositing, or other methods.

Figure 1:
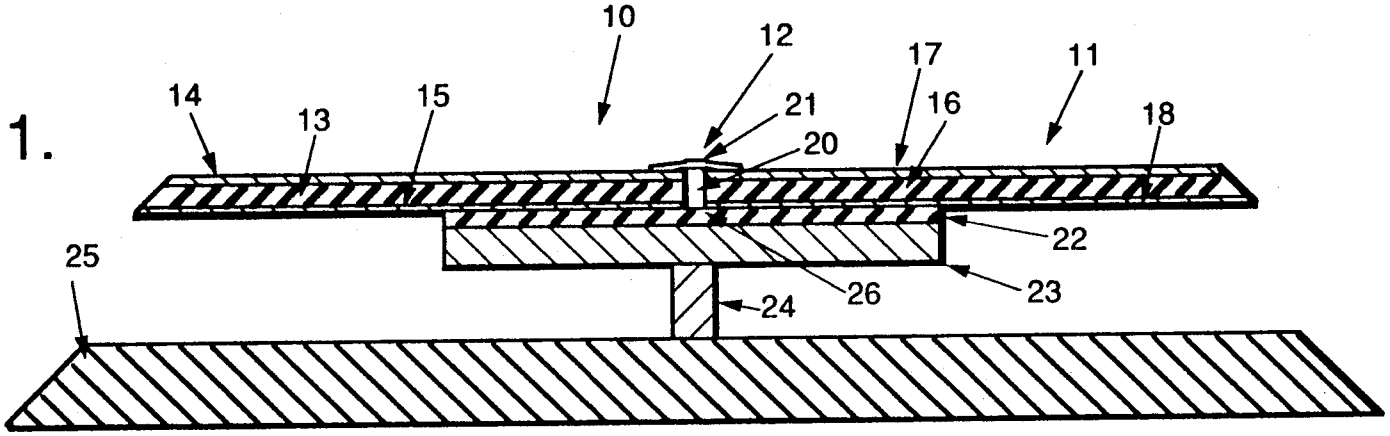
FIG. 1 is a side view in cross section illustrating the construction of a ground plane choke in accordance with the invention employed at the interface between two strip transmission line substrates.

Referring now to FIG. 1 of the drawings, there is shown first and second strip transmission line substrates 10, 11 meeting at an interface 12. The first strip transmission line substrate 10 comprises an insulating substrate 13 having a metallic circuit conductor 14 on one side thereof, and a metallic ground plane 15 on the other side. Similarly, the second strip transmission line substrate 11 is comprised of an insulating substrate 16 having a metallic circuit conductor 17 on one side thereof, and a metallic ground plane 18 on the other side. Where the first and second strip transmission line substrates 10, 11 meet at the interface 12, there is provided a gap 20. The gap 20 is to allow for thermal expansion between the first and second strip transmission line substrates 10, 11. The metallic circuit conductors 14, 17 of the two strip transmission line substrates 10, 11 are connected together by a metallic wire or ribbon 21 having an omega-shaped loop to provide for thermal expansion or contraction.

The two ground planes 15, 18 are not electrically connected by a metal-to-metal connection. In accordance with the present invention, the ends of the two strip transmission line substrates 10, 11 which meet at the interface 12 are supported by resting on top of a structure comprising a dielectric member 22, a metal choke member 23, and a conductive pedestal 24. The conductive pedestal 24 is mounted to a grounded metal carrier, chassis, or container 25, as by soldering, welding or fasteners. Similarly, the metal choke member 23 is attached to the conductive pedestal 24 by soldering, welding or fasteners. The preferred construction is the machining of the structure comprising the choke member 23, the conductive pedestal 24 and the metal carrier, chassis or container 25 as an integral unit. The dielectric member 22, in the present example, is made of a ceramic loaded PTFE (polytetrafluoroethylene) Teflon material having a dielectric constant of approximately 10. Many other dielectric materials are suitable for use in this application. The metal choke member 23 is circular in shape and is designed to have a radius equal to one quarter effective wavelength in the dielectric at the frequency of operation. The dielectric member 22 is shown as having a circular shape to match the metal choke member 23. The ground planes 15, 18 of the first and second strip transmission line substrates 10, 11 are in contact with the dielectric member 22 but they are free to move relative to the metal choke member 23 when thermal expansion or contraction occurs.

In accordance with the invention, the metal choke member 23, the dielectric member 22, and the ground planes 15, 18 form a low-loss RF ground connection to bridge the gap 20 at the interface 12. These members form a quarter wave open circuit transmission line stub in the form of a circular structure. This structure acts as an RF choke and reflects a short circuit into the region 26 between the ground planes 15, 18 making a virtual connection between the ground planes 15, 18 and the metal choke member 23. Thus, a wave traveling from left to right along the first strip transmission line substrate 10 will transfer uninterrupted to the second strip transmission line substrate 11 at the interface 12 by propagating through the metallic conductive ribbon 21 and the virtual short circuit region 26 in the gap 20. In the gap 20, the metal choke member 23 becomes the effective ground plane of the two strip transmission line substrates 10, 11. The ground path is from ground plane 15 through the dielectric member 22 to the metal choke member 23, across the virtual short circuit region 26, from the metal choke member 23 through the dielectric member 22 to ground plane 18. This path length electrically is, as is necessary, essentially the same as the path length from circuit conductor 14 over metal ribbon 21 to circuit conductor 17.

Referring now to FIG. 2, there is shown a second embodiment of the RF choke of the present invention in which a strip transmission line medium 30 comprises a substrate 31 having a ground plane 32 on the lower side thereof, and a circuit conductor 33 on the upper side thereof. It will be understood that FIG. 2 shows merely an end portion of a strip transmission line medium 30 at an interface. The member with which the strip transmission line medium 30 is interfacing is not shown. A semicircular choke member 34 has a metal pedestal 35 extending at right angles thereto and fastened to a metal carrier 36 as by soldering, welding or fasteners. Between the semicircular metal choke member 34 and the ground plane 32 of the substrate 31 there is a dielectric spacer 37. The semicircular choke member 34 has a radius of one quarter wavelength in the dielectric at the frequency of operation from the center point below the circuit conductor 33 at the edge of the substrate 31.

It is not necessary that an actual dielectric spacer 37 be used. Air may be used as the dielectric if space permits, and if mechanical arrangements are provided to separate the semicircular metal choke member 34 from the ground plane 32.

The actual physical size of the semicircular metal choke member 34 depends on the dielectric constant of the dielectric spacer 37 as well as on the frequency of operation. If air were used as the dielectric or the space was partially filled with dielectric, the semicircular metal choke member 34 would be larger in size. However, in the present example, the dielectric spacer 37 is made of a ceramic-loaded PTFE (polytetrafluoroethylene) Teflon composite having a dielectric constant of about 10 and filling the space completely which substantially reduces the radius of the semicircular choke member 34. Many other dielectric materials are suitable for use in this application. Although the dielectric spacer 37 is shown as being semicircular with a radius to match that of the semicircular choke member 34, it may extend beyond the metallic choke member 34 at which point it may be any shape and size, e.g., rectangular and coextensive with the substrate 31. It is only necessary that within the confines of the metal choke member 34 and at or near the perimeter of the metal choke member 34, it matches the shape of the semicircular metal choke member 34.

The operation of the RF choke may be understood by considering the current in the ground plane 32 directly under the transmission line conductor 33 and near the edge of the substrate 31. This current is confined sufficiently to be considered a point source. The interrupted point source current excites a radially emanating wave between the strip transmission line ground plane 32 and the semicircular metal choke member 34. Since the semicircular metal choke member 34 has a radius equal to one quarter of the effective wavelength, the arrangement is essentially a one quarter wavelength opencircuit radial transmission line stub.

The perimeter of the transmission line stub is defined by the dielectrically loaded semicircular metal choke member 34 and that portion of the ground plane 32 opposing the choke member 34. The resulting RF opencircuit at this perimeter presents a short-circuit for the RF energy at the center of the semicircle where the effective point source of RF current is located. This virtual short circuit connects the semicircular metal choke member 34 to the ground plane 32. The semicircular choke member 34 thus becomes the effective ground plane of the strip transmission line medium 30. This provides low-loss RF coupling while allowing relative movement due to thermal expansion or contraction.

The RF choke employed in the ground plane of the strip transmission line medium is not restricted to a radial length of one quarter effective wavelength in the dielectric member at the frequency of operation. The radial dimension of the open circuited transmission line stub is allowed to equal odd multiples of a quarter effective wavelength in the dielectric member at the frequency of operation-e.g., three quarters, five quarters, and etc. Applications requiring multiple quarter wavelength radial dimension are at higher frequencies where one quarter wavelength would present fabrication difficulties.

Figure 3:
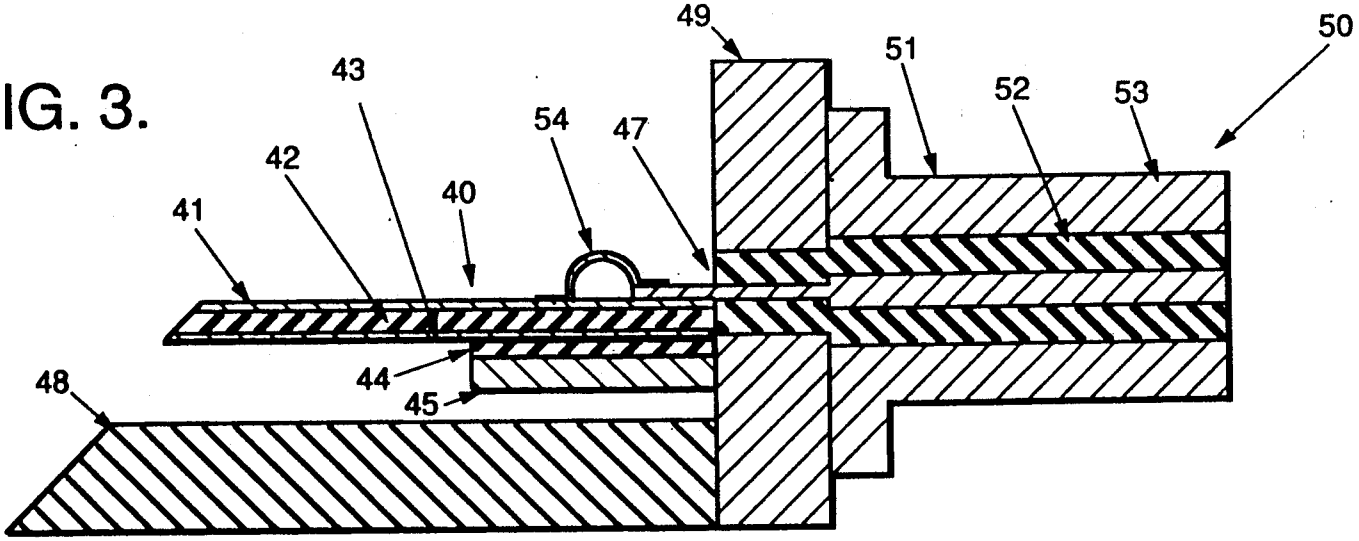
FIG. 3 is a side view in cross section of an embodiment of the RF choke of the present invention employed at the interface between a strip transmission line substrate and a coaxial connector.

Referring now to FIG. 3, there is shown an embodiment of the present invention employed at an interface 47 of a strip transmission line medium 40 to a coaxial cable connector 50. The figure illustrates in cross-section a side view of the interface 47 along the centerline of the strip transmission line medium 40 and the coax connector 50. The strip transmission line medium 40 is comprised of a circuit conductor 41, a strip transmission line substrate 42, and a substrate ground plane 43 all laminated together. Below the strip transmission line medium 40 is a dielectric spacer 44 and a semicircular metal choke member 45. A metal carrier, chassis or container 48 has an end wall 49 that carries the coaxial connector 50.

The coaxial connector 50 has an outer shell 51 connected to the end wall 49 and a dielectric 52 supporting a center pin 53 in the middle thereof. The circuit conductor 41 of the strip transmission line medium 40 is connected to the center pin 53 of the coaxial connector 50 by a wire or ribbon 54 which may be welded or soldered at each end. The ribbon 54 may be provided with an omega-shaped loop to allow for thermal expansion. The ground plane 43 of the strip transmission line medium 40 rests on the dielectric spacer 44 but is free to move with thermal expansion. The semicircular metal choke member 45 is integral with the end wall 49 although it may be affixed thereto as by soldering or welding, if desired.

At the interface 47, the ground path is from the ground plane 43 of the strip transmission line medium 40, through the dielectric spacer 44 to the semicircular metal choke member 45, across to the end wall 49 and to the outer shell 51 of the coaxial cable connector 50. Thus, a low-loss RF ground plane connection is made across the interface 47 from the substrate ground plane 43 to the coaxial connector 50 by means of a virtual short circuit created by the quarter wavelength open circuited stub. Although there is no metal-to-metal contact, the semicircular metal choke member 45 serves as the ground plane for the strip transmission line medium 40 in bridging across the interface 47 while allowing relative movement due to differing thermal expansion or contraction of the substrate 42 and the chassis 48. The ground path through the choke member 45 should be made to have the same electrical length as the center conductor path through the ribbon 54.

Referring now to FIG. 4 of the drawings, there is shown a chassis 60 of a microwave system illustrating the interconnection of first and second strip transmission line substrates 61, 62 between first and second coaxial cable connectors 63, 64 and a microwave circuit element 65, which may be a packaged high power microwave transistor for a solid state radar, for example.

The present invention is especially useful in large strip transmission line assemblies such as those used in solid state radars. Each solid state radar incorporates large numbers of amplifier modules, each of which in turn contain numerous strip transmission line substrates and assemblies. The present invention solves the thermal expansion mismatch problem, thereby making possible the use of larger substrates, which reduces the number of RF interconnects, as well as making easier the assembly and replacement of these substrates. Thus, the present invention makes possible the production of solid state amplifiers at reduced cost by providing a good RF ground connection at electrical interfaces without employing a metal-to-metal connection.

In FIG. 4, a signal from coaxial connector 63 is coupled to the first strip transmission line substrate 61 by way of a metallic ribbon 66 connected to the circuit conductor 67 and by way of a semicircular metal choke member 68 coupling to the ground plane on the underside thereof. The signal travels along the first strip transmission line substrate 61 and couples to the microwave circuit element 65 by way of a metallic ribbon 70 and another semicircular metal choke member 71.

Similarly, the signal leaves the microwave circuit element 65 by way of another metallic ribbon 72 connected to circuit conductor 73 of the second strip transmission line substrate 62, and by way of semicircular metal choke member 74 which couples to the ground plane of the second strip transmission line substrate 62. The signal travels along the second strip transmission line substrate 62 and is coupled to the second coaxial connector 64 by way of another metallic ribbon 75 and a semicircular metal choke member 76.

As shown in FIG. 4, expansion gaps 77, 78, 79, 80 have been provided at the interfaces to permit thermal expansion and relative motion between the strip transmission line substrates 61, 62 and the chassis 60. The strip transmission line substrates 61, 62 rest on and are supported by dielectric spacers (not shown) disposed on the semicircular metal choke members 68, 71, 74, 76 but are free to move with respect thereto. The strip transmission line substrates 61, 62 lightly press the dielectric spacers against the choke members 68, 71, 74, 76. It will be understood that fasteners are located beyond the high-field regions in the vicinity of the circuit conductors 67, 73 to apply pressure and to maintain the proper positions of the strip transmission line substrates 61, 62 in relation to coaxial connectors 63, 64 and the microwave circuit element 65.

The particular embodiments of the present invention described are based on an effective quarter wavelenght open circuited transmission line stub. In place of an open circuited stub, a short circuited transmission line stub can be employed to form the RF choke. The dimension of this short circuited stub/choke becomes one half effective wavelength at the frequency of operation. Referring to FIG. 5, there is shown an embodiment of the present invention employing a one half effective wavelength short circuited transmission line stub/RF choke 100. The arrangement shown in FIG. 5 is a modification to the embodiment shown in FIG. 4. Added to the effective quarter wavelength transmission line formed between the ground plane 101 of the substrate 102 and the top of the metallic choke member 103 as in the embodiment shown in FIG. 4, is an effective quarter wavelength short circuited transmission line stub 104 wrapped back and under the metallic choke member 103 giving a total RF choke effective shorted stub length of one half wavelength. The radial dimension from the short or pedestal 105 to the perimeter of the semicircular choke member 103 plus the thickness of the choke member 103 is designed to be an effective quarter wavelength thereby generating an open circuit at the perimeter of the choke member 103. The operation then becomes identical to the arrangement in FIG. 4 since an effective quarter wavelength open circuited radial transmission line stub has been formed.

Comparative transmission and reflection measurements have been made. The performance of a microwave circuit employing the RF ground plane choke of the present invention was compared to the same microwave circuit with the semicircular dielectric spacers wrapped with one mil thick copper foil. The foil-wrapped dielectric spacers connect the ground plane of the strip transmission line substrates to the metal choke members to simulate bonding by using solder or conductive epoxy cement the ground planes to the carrier, thus making metal-to-metal connections. It was found that the use of the RF ground plane choke of the present invention did not adversely affect VSWR and insertion loss.

Thus there has been described a new and improved RF ground connection for strip transmission line transmission media that provides a low-loss RF ground without making metal-to-metal contact at critical interfaces. This ground connection permits relative motion between the strip transmission line substrate and its carrier, thus allowing for thermal expansion or contraction and for easy repair or replacement.

It is to be understood that the above-described embodiments are merely illustrative of some of the many specific embodiments which represent applications of the principles of the present invention. Numerous and other arrangements can be readily devised by those skilled in the art without departing from the scope of the invention.

What is claimed is:

1. A choke joint for providing a non-contacting ground plane to ground plane connection between a strip transmission line and a second transmission element, said strip transmission line including a dielectric substrate, a metallic strip conductor disposed on a first side of said dielectric substrate, and a conductive ground plane disposed on a second side of said dielectric substrate, said second transmission element including a first conductor element, a second conductor element serving as a ground plane and a dielectric element separating said first conductor element and said second conductor element, said choke joint comprising:

a) said strip transmission line and said second transmission element being disposed such that a first gap is provided between said metallic strip conductor and said first conductor element and a second gap is provided between said conductive ground plane and said second conductor element;

b) a dielectric member disposed on the conductive ground plane of said transmission line;

c) a curved metallic choke member disposed on the dielectric member, said curved metallic choke member having a radius of approximately one-quarter wavelength of the dielectric member at the operating frequency of the strip transmission line or a radius of odd multiples of said one-quarter wavelength;

d) means for coupling said curved metallic choke member to a system ground; and e) extensible metallic means for coupling said strip conductor to said first conductor.

2. A choke joint as recited in claim 1 wherein said extensible metallic means is a wire having a loop.

3. A choke joint for providing a non-contacting ground plane to ground plane connection between a first strip transmission line and a second strip transmission line element, said first strip transmission line including a first dielectric substrate, a first metallic strip conductor disposed on a first side of said first dielectric substrate, and a first conductive ground plane disposed on a second side of said first dielectric substrate, said second strip transmission line including a second dielectric substrate, a second metallic strip conductor disposed on a first side of said second dielectric substrate, and a second conductive ground plane disposed on a second side of said second dielectric substrate, said choke joint comprising:

a) said first strip transmission line and said second strip transmission line being disposed such that a first gap is provided between said first metallic strip conductor and said second metallic strip conductor, a second gap is provided between said first conductive ground plane and said second conductive ground plane, and a third gap is provided between said first dielectric substrate and said second dielectric substrate, said gaps permitting thermal expansion or contraction of said first and second strip conductors, said first and second dielectric substrates and said first and second conductive ground planes;

b) a dielectric member disposed on the first and second conductive ground planes of said strip transmission lines;

c) a curved metallic choke member disposed on the dielectric member, said curved metallic choke member having a radius of approximately one-quarter wavelength of the dielectric member at the operating frequency of the strip transmission line or a radius of odd multiples of said one-quarter wavelength;

d) means for coupling said curved metallic choke member to a system ground; and e) extensible metallic means for coupling said first strip conductor to said second strip conductor.

4. A choke joint as recited in claim 3 wherein said extensible metallic means is a wire having a loop.

5. A choke joint for providing a non-contacting ground plane to ground plane connection between a strip transmission line and a coaxial transmission line, said strip transmission line including a dielectric substrate, a metallic strip conductor disposed on a first side of said dielectric substrate, and a conductive ground plane disposed on a second side of said dielectric substrate, said coaxial transmission line including a center conductor element, an outer conductor and a dielectric element separating said center conductor and said outer conductor, said choke joint comprising:

a) said strip transmission line and said second coaxial transmission line being disposed such that a first gap is provided between said metallic strip conductor and said center conductor and a second gap is provided between said ground plane and said outer conductor;

b) a dielectric member disposed on the conductive ground plane of said strip transmission line;

c) a curved metallic choke member disposed on the dielectric member, said curved metallic choke member having a radius of approximately one-quarter wavelength of the dielectric member at the operating frequency of the strip transmission line or a radius of odd multiples of said one-quarter wavelength;

d) means for coupling said curved metallic choke member to a system ground; and e) extensible metallic means for coupling said strip conductor to said first conductor.

6. A choke joint as recited in claim 5 wherein said extensible metallic means is a wire having a loop.

* * * * *